United States Patent [19]

Rydz et al.

[11] 4,052,946

[45] Oct. 11, 1977

[54] ELECTRONIC CONTROL PACKAGE FOR SEWING MACHINE

[75] Inventors: John Stephen Rydz, Scotch Plains; John Whilldin Wurst, Dover, both of N.J.

[73] Assignee: The Singer Company, New York, N.Y.

[21] Appl. No.: 670,778

[22] Filed: Mar. 26, 1976

[51] Int. Cl.[2] ..... D05B 3/02

[52] U.S. Cl. ..... 112/158 E

[58] Field of Search ..... 112/158 E, 121.11, 121.12, 112/219 A, 258; 318/567, 569

[56] References Cited

U.S. PATENT DOCUMENTS

| | | | |
|---|---|---|---|
| 3,400,677 | 9/1968 | Bowers et al. | 112/219 A |
| 3,872,808 | 3/1975 | Wurst | 112/158 E |
| 3,982,491 | 9/1976 | Herzer et al. | 112/121.12 |
| 4,004,528 | 1/1977 | Adams et al. | 112/258 X |

*Primary Examiner*—Werner H. Schroeder
*Assistant Examiner*—Peter Nerbun
*Attorney, Agent, or Firm*—Edward L. Bell; Robert E. Smith; Edward P. Schmidt

[57] ABSTRACT

An electronic control package for a sewing machine having a frame supporting functional components such as thread handling components, a needle bar gate and needle bar, feed system, electrical actuating means for the needle bar gate and feed system, electric drive means, transformer, power supply and pulse generator. A panel supporting pattern selection and other sewing machine control means may be combined with a printed circuit board carrying control circuitry including a pattern memory means and electronics required to convert pattern information from the memory means to a form usable by the electrical actuating means for control of needle position and, if desired, for regulation of feed. By exchanging panels, the type of control and appearance of the machine may be altered as desired. By exchange of panel and printed circuit board major changes in machine feature capability and appearance may be accommodated.

8 Claims, 5 Drawing Figures

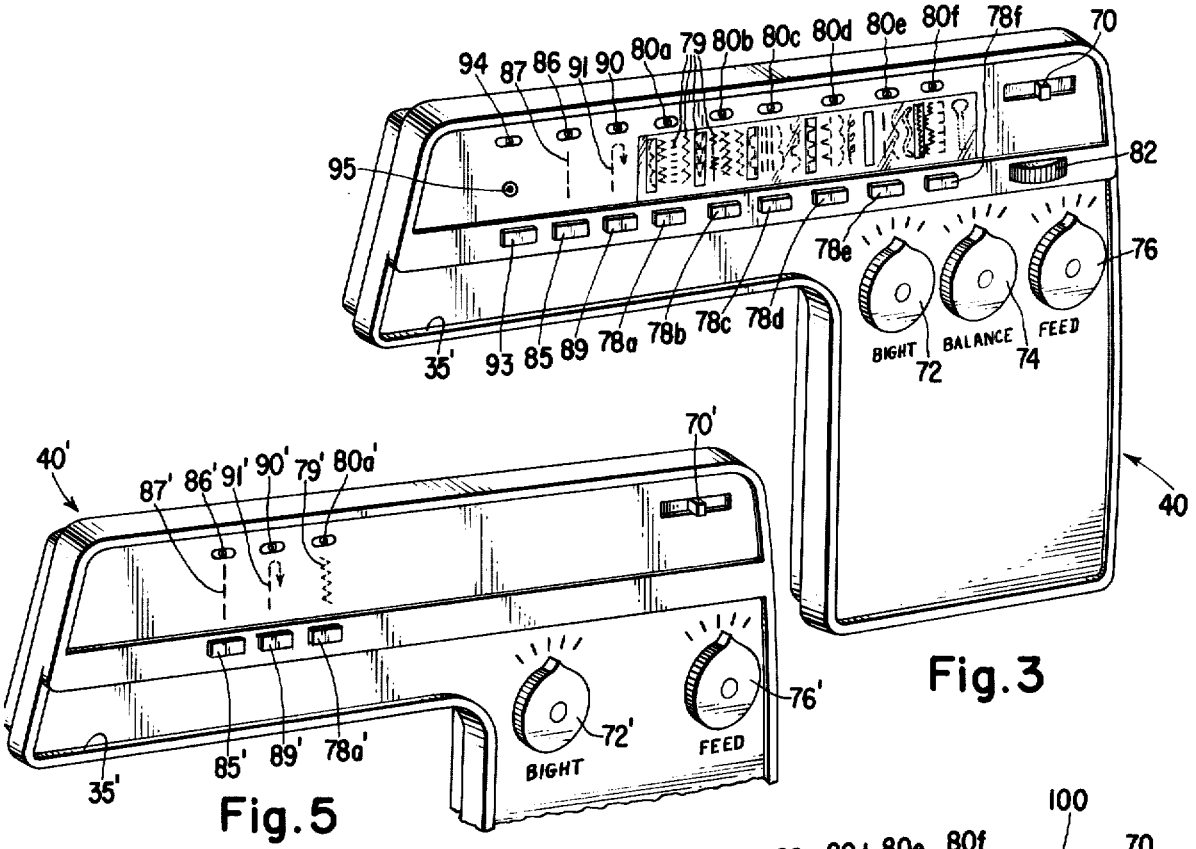
Fig. 3
Fig. 5
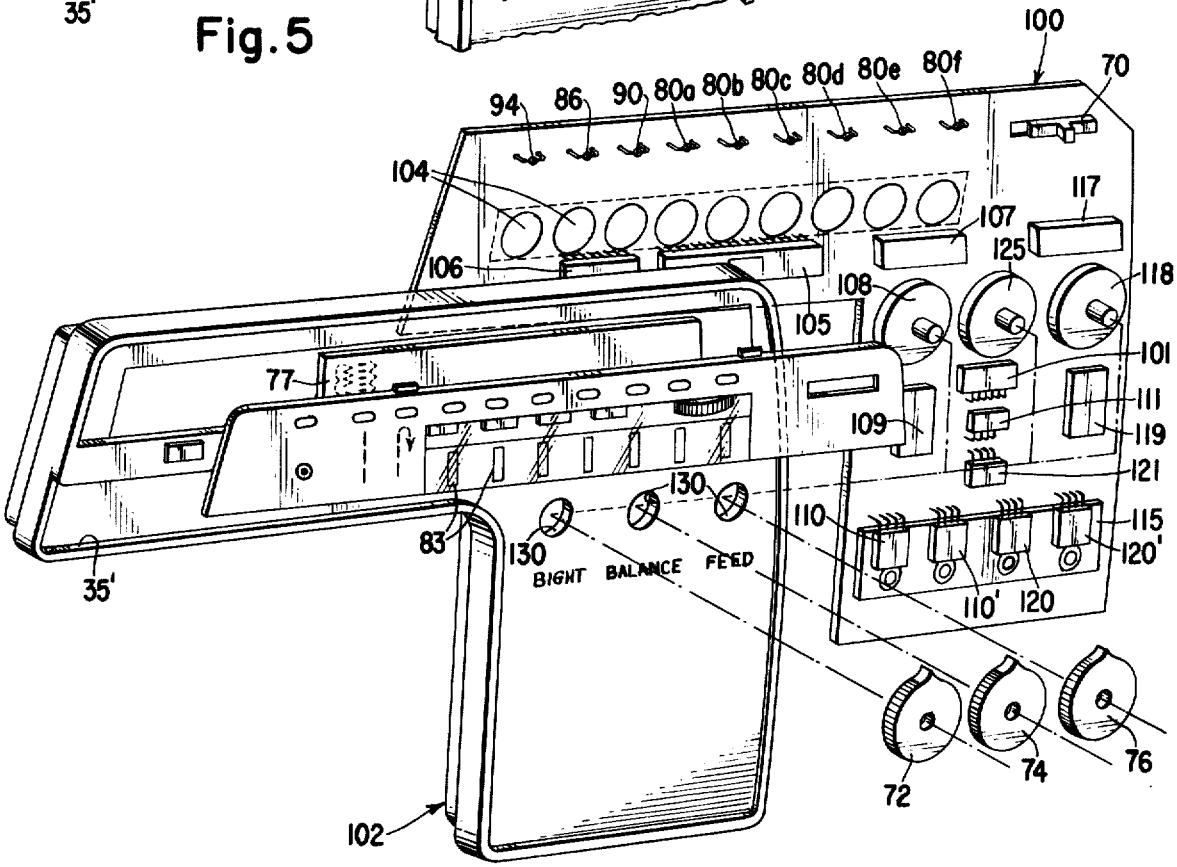
Fig. 4

ELECTRONIC CONTROL PACKAGE FOR SEWING MACHINE

BACKGROUND OF THE INVENTION

Heretofore, feature capability and appearance of a household sewing machine is determined very early in the manufacture of the sewing machine. For example, a specific pattern capability is built into a given sewing machine, requiring the inclusion of specific pattern cams. Production of a line of machines having less pattern capability requires the elimination of some of these specific pattern cams with corresponding changes in the pattern selection system and possibly in the sewing machine frame. A change in appearance and method of control also required more or less extensive modification to the sewing machine frame.

Similarly, the addition of features such as single pattern sewing capability, safe twin needle sewing capability, change from square end to round end buttonhole, or, change in preset stitch parameters require additions or changes to sewing machine components and to the sewing machine frame which, depending on the feature added, may be drastic and expensive in the prior art sewing machines.

The aforementioned method of manufacture tends somewhat to inhibit freedom of choice in adding machine features, in adding or deleting sewing patterns available, in changing type of control such as from push button controls to dial controls, and in changing appearance of the sewing machine wherein the change desired would require extensive modification. What is required is a ready means of changing the feature capability, method of control and/or appearance of a sewing machine without the requirement for radial changes to the sewing machine frame or components heretofore required.

SUMMARY OF THE INVENTION

The above desired end is achieved in an electronically controlled sewing machine where all the functional sewing machine components, i.e. the thread handling means such as tension and take-up, needle bar gate and needle bar, feed system, electrical actuating means for the needle bar reciprocation and the feed system, main drive motor, transformer, power supply and pulse generator, are supported by the sewing machine frame. Control of the appropriate functional components is effected by an electronic control package implemented by a electronic circuit board carrying those electronic components required to attain the desired feature capability, and an associated panel providing the desired appearance and necessary access to the printed circuit board. Change in desired feature capability and/or in appearance is accommodated by replacing the original electronic control package with an electronic control package having the desired attributes. Change in type of control is also readily achieved by substitution of electronic control package. Sewing machine feature capabilities, as for example straight stitch safety device permitting only straight stitching with a straight stitch throat plate, are more readily attained because a minimum of change to the sewing machine frame is required with a suitable change in the electronic control package.

DESCRIPTION OF THE DRAWINGS

For a better understanding of the invention and the advantages thereof, reference may be had to the attached specification and accompanying drawings wherein:

FIG. 3 is a detached perspective of the electronic control package;

FIG. 4 is a partially disassembled perspective view of the electronic control package shown in FIG. 3; and, FIG. 5 is a detached perspective of part of a second electronic control package.

In FIG. 1 is shown a sewing machine 10 having a work supporting bed 11 from which rises a standard 12 to support an upwardly open arm 14 overhanging the bed. The arm 14 terminates in a head end 16 within which is supported a needle bar gate 18 (shown diagramatically in FIG. 2) and presser bar 19. The needle bar gate 18 supports a needle bar 20 for lateral oscillation and endwise reciprocation in any well known manner. The needle bar 20 supports needle 21 for cooperation with sewing instrumentalities (not shown) in the bed 11. Attached to the end of the presser bar 19 by screw 23 is a presser foot 24, which is urged in the usual manner by a presser mechanism (not shown) against a feed dog 25 part of a feed mechanism (not shown) located in the bed 11.

Figure 1:
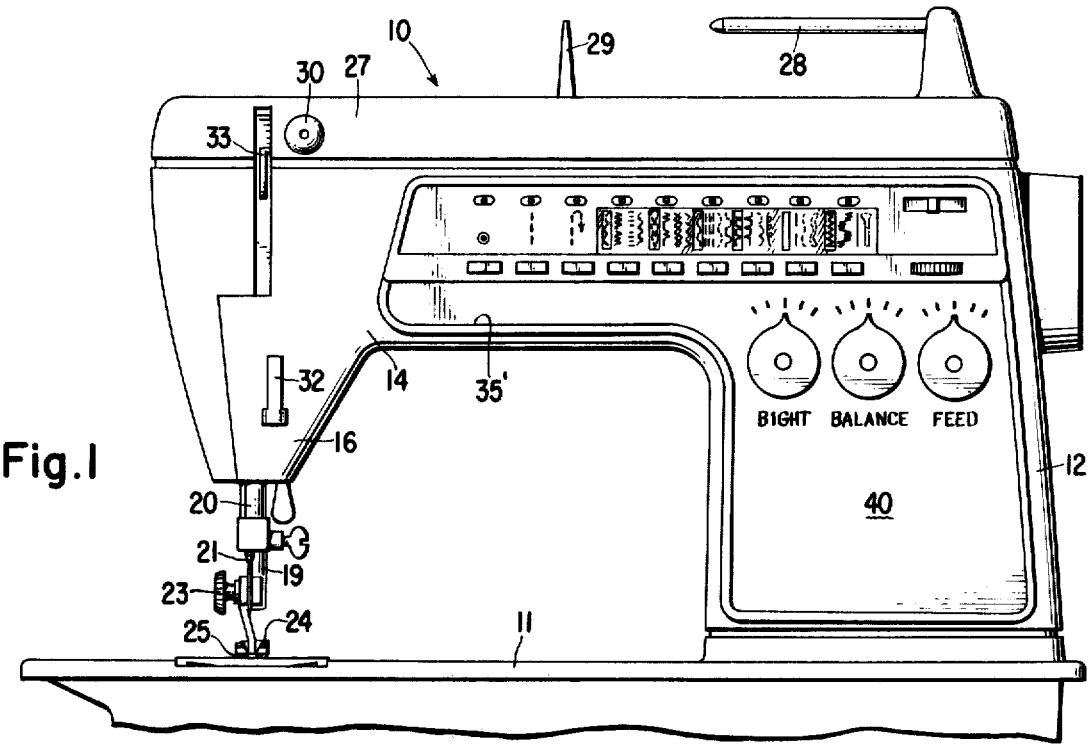
FIG. 1 is a front elevation of a sewing machine with an electronic control package in place.

The upwardly open arm 14 is covered by a top cover 27 on which is supported a spool pin 28, thread guide 29 and top cover tension 30. Thread from a thread spool positioned on the spool pin 28 is directed through the thread guide 29 to the top cover tension 30, downwardly about pivot post 32 and then upwardly about take up lever 33 which undergoes thread take-up action in synchronism with endwise reciprocation of the needle bar 20 by any one of several methods well known in the prior art.

In the embodiment of the invention depicted in FIGS. 1 through 4 the standard 12 and the arm 14 is formed with a frontal opening 35 (see FIG. 2) designed to receive a portion of an electronic control package 40 to be further explained below. The exact location and size of the opening provided in a matter of design discretion, there being many possible arrangements of features and type of controls which may be combined in larger or in smaller openings to satisfy any concept of industrial design. More than one opening may be provided with more than one panel for functional or aesthetic reasons.

Figure 2:
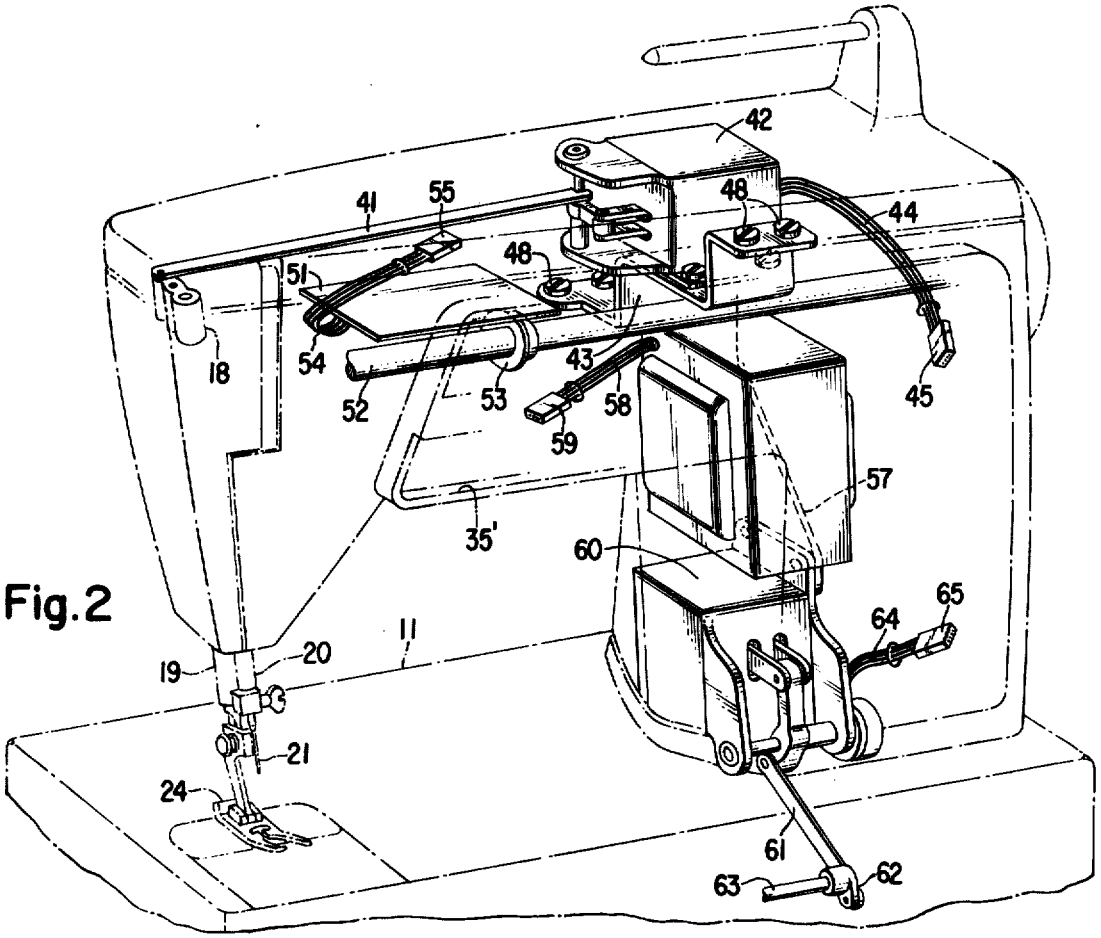
FIG. 2 is a perspective view of the sewing machine in phantom showing the placement of some of the functional components within the sewing machine.

In FIG. 2 the sewing machine 10 is shown in phantom to expose to view some of the functional components of the sewing machine required for operation. The functional components desired may be permanently or semi permanently supported by the sewing machine frame. Provision may be made in the frame for supporting feature components desired for a deluxe line of machines without the necessity for supporting these feature components in all frames. In FIG. 2 is shown the needle bar gate 18, supported in the head end 16 of the arm 14, connected by driving arm 41 to a bight linear motor 42 supported on bracket 43 attached to the sewing arm frame 14. Electrical leads 44 to the linear motor 42 terminate in bight connector 45.

A printed circuit board 51 is supported in the arm 14 adjacent an arm shaft 52 carrying pulse generating cam 53. The printed circuit board 51 carrys power supply components and those components necessary to the generation of a pulse in conjunction with the pulse generating cam 53 according to the teachings of, for example, the U.S. Pat. No. 3,815,531 of Wurst et al., issued on June 11, 1974 which is hereby incorporated by reference and made a part of this application. In that patent is disclosed the use of a pulse generating cam coupled to the main shaft of a sewing machine to rotate therewith, the cam having a portion which approaches a Hall effect device for a specific period each revolution to provide a pulse synchronized with a particular position of endwise needle reciprocation. The pulse so generated is used, as one example, to insure that the bight linear motor 42 will position the needle bar gate 18 only when the needle 21 is out of work fabric.

Low voltage power to the power supply board is obtained from a low voltage transformer 56 which is supported in the standard 12 on mounting bracket 57 as shown. Also supported on the mounting bracket 57 is a feed linear motor 60, which is connected by link 61 to a lever 62 affixed to a feed regulator shaft 63. The feed regulator shaft 63 is connected to a feed regulator (not shown) part of a feed system (not shown) which may be of a type well know in the sewing machine art.

Other functional components required but not shown for the sake of clarity include details of the tension and needle bar gate arrangement, driving mechanism for the needle bar, presser bar pressure regulating mechanism, take-up lever actuating mechanism, looptaker or looper and drive mechanism therefor, and main drive motor. All those components necessary to proper operation of the sewing machine may be mounted within the frame as they previously have been. In addition components required for a particular feature capability, such as a basting stitch mechanism, may be added when desired.

In FIG. 3 is shown an assembled electronic control package 40 required for control of the functional components supported in the sewing machine frame as well as feature components included to attain desired feature capability. Thus the electronic control package 40 provides a main power switch 70 with low and high speed and off position for the main drive motor, a bight control dial 72, a feed control dial 74, and a balance control dial 76 utilized during cam controlled feed and buttonhole to adjust reverse feed. Push buttons 78*a–f* are used to select a particular set of pattern indicated by indicia 79 on a movable display panel 77 (see FIG. 4). Selection of a particular set is indicated by Light Emitting Diodes (LED's) 80*a–f,* corresponding to push button 78*a–f* depressed. A dial 82 may be manipulated to move the display panel 77 to select a particular pattern in each set as indicated by the location of that particular pattern with block 83 formed of tinted glass or scribed lines in a transparent covering. Full particulars as to how pattern selection may be accomplished and construction and operation of this form of pattern selection may be had by reference to the U.S. Pat. No. 3,913,506, Oct. 21, 1975 of Adams et al., which is hereby incorporated by reference and made a part of this application. The dial 82 may be shifted to four positions and by means of a slide switch (not shown) movable with the display panel 77 is able to supply four bits of selection information in addition to that supplied by the push button 78*a–f* selected for depression.

In addition push button 85, corresponding LED 86 and indicium 87 provides for straight stitch sewing. A push button 89, corresponding to LED 90 and indicium 91 is supplied for reverse sewing. Feature capability may also be provided for, as for example, single pattern capability implemented by push button 93, with corresponding LED 94 and indicium 95.

FIG. 4 shows the electronic control package 40 of FIG. 3 partially disassembled to show the electronic circuit board 100 supporting the electronic components necessary to provide the required control functions, and the panel 102 providing the necessary access to the electronic circuit board for control purposes in an aesthetically pleasing and functional manner. The electronic circuit board 100 may be supported in the panel 102 to make an electronic control package 40 as is shown, or it may be supported on the sewing machine frame separate from but adjacent the panel for greater freedom in creating an aesthetically pleasing sewing machine appearance.

The electronic circuit board 100 supports the main power switch 70 and the LED'S 80*a–f,* 86, 90 and 94. The switch pack 104 accommodates the several momentary contact switches actuated by the push buttons 78*a–f,* 85, 89 and 93. The LSI (Large Scale Integration integrated circuit) 105 is a solid state memory which stores bight and feed information for pattern sewing as well as other control information for control of the functional components and feature components as desired. For the sake of simplicity only those components necessary for control of bight and feed are shown. More detailed information on the electronic components and circuitry may be had by reference to the U.S. Pat. No. 3,872,808, Mar. 25, 1975 of Wurst, which is hereby incorporated by reference and made a part of this application. Thus when a pattern is selected by depressing one of the push buttons 78*a–f* and rotation of the dial 82, an address count is directed to the LSI 105 releasing pattern information in digital form from the LSI. Pulses generated by the pulse generating cam 53 and pulse generating components on printed circuit board 51 are transferred via leads 54 and connector 55 to the electronic circuit board 100 through terminals 101 along with the power required for the various electronic components mounted on the electronic circuit board. The pulses are counted in address counter 106, which increases the address count to the LSI 105 for sequential release of digital pattern information therefrom. At the end of the pattern information for a specific pattern in the LSI 105, the LSI release an end of pattern digital code word which reverts the address counter to the address count selected by one of the push buttons 78*a–f* and dial 82, where upon the digital pattern information is repeated.

The digital pattern information from the LSI 105 is transferred to D/A (digital to analog) converters for bight 107 and feed 117. Potentiometer 108 attenuates the analog signal transferred from the D/A converter 107 to the bight servo amplifier 109 so that width of a decorative pattern may be adjusted from maximum bight. Bight power transistors 110, 110' supported on a heat sink 115, supply the power to the bight linear motor 42 via leads 44 and connector 45 and terminals 111. The heat sink 115 is fashioned with convection fins (not shown) on the rear side of board 100 to aid heat transfer therefrom.

The feed signal from the D/A converter 117 is attenuated by potentiometer 118 for adjustment of the feed signal from feed servoamplifier 119 to power transistors 120, 120' also supported on heat sink 115, and ultimately the feed linear motor 60 by leads 64 and connector 65 on the linear motor to terminals 121 on the electronic control board 100.

The balance control potentiometer 125 is connected to the power supply printed circuit board 51 through the terminal strip 101, connector 55 and leads 54. Through the balance control potentiometer 125, a bias voltage variable as to sign and level may be impressed on feed servoamplifier 119 in order to adjust forward to reverse feed in the making of a buttonhole or in other feed patterns.

Access to the wipers of the bight potentiometer 108, feed potentiometer 118 and balance potentiometer 125 is provided by knobs 72, 76 and 74, respectively, mounted on wiper shafts which protrude through holes 130 in the panel 102.

Selection of a given pattern by depression of a push button 78 *a–f* and rotation of dial 82 followed by depression of push button 93 will cause electronic control components supported on the electronic control board 100 to respond to the end of pattern digital code word previously referred to, in a fashion to inhibit further machine stitching operation until the push button 93 or selected push button 78*a–f* is again depressed. Further explanation of the manner in which this is achieved may be had by reference to the commonly owned U.S. Pat. application No. 602,693 filed on Aug. 7, 1975 which is hereby incorporated by reference and made a part of this application.

The above feature capability is one of many which may be included in an electronic control package. Many other feature capabilities may be more or less readily provided for by simple substitution of an electronic control package 40. By suitable differences in the electronic control packages 40 such feature capability may be accommodated as limiting bight for twin needle sewing, changing pattern capability to suit marketing demand, changing type of buttonhole (round end of square end), changing preset stitch parameters, or adding of safety features such as inhibiting bight when using a straight throat plate. Other feature capabilities will suggest themselves to those skilled in the art which may be readily incorporated into a sewing machine by the means of this invention.

In FIG. 5 a portion of a much simplified electronic control package 40' is shown having the capability for forward and reverse feed and zig-zag stitch only. Thus the inclusion of the electronic control package 40' would obviously provide a basic, bottom of the line sewing machine having significantly less capability than that provided in a sewing machine using the electronic control package 40 shown in FIG. 3, but still using the major functional components of that machine. It will be apparent to those skilled in the art the changes required of the electronic circuit broad 100 shown in FIG. 4, to provide an electronic control package 40'.

As previously noted the panel 102 and electronic control board 100 may be separately supported in the sewing machine with only such proximity required as is necessary to provide access from the panel to the electronic control board. To one skilled in the art it will be apparent that the potentiometers 108, 118 and 125 may be mounted on the panel 102 thereby requiring electrical rather than mechanical connection to electronic control board with a considerable increase in flexibility of design. Similar accommodation may be made for the switch pack 104 and LED'S 80*a–f*, 86, 99 and 94, on the panel 102 with electronical connections only required to the electronic control board 100. Other electronic selection systems are also readily implemented using for example, toggle switches or dial type slide switches which will be equally as effective as the push button switches of the embodiment. On the other hand all the components may be supported on the electronic control board 100 with the panel 102 serving only a decorative function. In this latter case all the pattern selection elements of this embodiment would be supported by the electronic control board 100 to protrude through openings in the panel 102.

Although the embodiment disclosed is of the usual household sewing machine it is apparent that the invention will find application in those machines where a work clamp is utilized in place of a feed dog feeding system. In certain of these cases, additional information may be required to be stored in the LSI 105 with an additional D/A converter, servoamplifier and actuator to accommodate the two dimensional feed motion required.

Having thus set forth the nature of the invention what we seek to claim is:

1. In a sewing machine having a frame with at least one opening in a portion accessible to a sewing machine operator, said frame including a bed supporting functional components including a feed system and sewing instrumentalities, a standard rising from said bed and terminating in an arm overhanging said bed; said arm carrying functional components including a needle carrying needle bar for endwise reciprocation in cooperative arrangement with said sewing instrumentalities in said bed; said frame supporting functional components including at least a drive system for reciprocating said needle bar and driving said feed system, and regulating means for said feed system; wherein the improvement comprises;

an electronic control unit, one of a plurality of possible electronic control units, each having electronic means including control components and electronic circuitry selectively effective to influence said functional components and panel means providing operator access to said electronic means for selective control of said functional components; means interchangeably supporting said electronic control unit with said panel means in said at least one opening in said frame; and means interconnecting said electronic control unit and said functional components.

2. In a sewing machine having a frame with at least one opening in a portion accessible to a sewing machine operator, said frame including a bed supporting functional components including a feed system and sewing instrumentalities, a standard rising from said bed and terminating in an arm overhanging said bed; said arm carrying functional components including a laterally oscillatable needle bar gate, said needle bar gate supporting a needle carrying needle bar for endwise reciprocation in cooperative arrangement with said sewing instrumentalities in said bed; said frame supporting functional components including a drive system for reciprocating said needle bar and driving said feed system, a pulse generator means operating in timed relation with said needle bar endwise reciprocation, power supply means, electrical actuating means for said needle bar gate lateral oscillation, and regulating means for said feed system; wherein the improvement comprises;

an electronic control unit, one of plurality of possible electronic control units, each having electronic means including control components, memory means and electronic circuitry selectively effective to influence said functional components, and each having panel means providing operator access to said electronic means for selective control of said functional components; means interchangeably supporting said electronic control unit with said panel means in said at least one opening in said frame; and means interconnecting said electronic control unit and said functional components.

3. In a sewing machine having a frame with at least one opening in a portion accessible to a sewing machine operator, said frame including a bed supporting functional components including a feed system and sewing instrumentalities, a standard rising from said bed and terminating in an arm overhanging said bed; said arm carrying functional components including a laterally oscillatable needle bar gate, said needle bar gate supporting a needle carrying needle bar for endwise reciprocation in cooperative arrangement with said sewing instrumentalities in said bed; said frame supporting functional components including a drive system for reciprocating said needle bar and driving said feed system, a pulse generator means operating in timed relation with said needle bar endwise reciprocation, power supply means, electrical actuating means for said needle bar gate lateral oscillation, and regulating means for said feed system; wherein the improvement comprises;

an electronic control unit, one of a plurality of possible electronic control units, each having electronic means including control components, memory means and electronic circuitry responsive to pulses generated by said pulse generator to release information from said memory means and convert said information to a form usable by said electrical actuating means for oscillation of said needle bar gate in the formation of sewing patterns, and each having panel means providing operator access to said electronic means of said electronic control unit for release of selected pattern information from said memory means to said electronical actuating means; means interchangeably supporting said electronic control unit with said panel means in said at least one opening in said frame; and means interconnecting said electronic control unit and said functional components.

4. In a sewing machine as claimed in claim 3 wherein said electronic circuitry on said electronic control unit is also responsive to pulses generated by said pulse generator to release pattern information from said memory means and convert said information to a form usable by said regulating means for said feed system in the formation of sewing patterns.

5. In a sewing machine as claimed in claim 2 wherein said panel means providing access to said electronic means includes apertures in said panel means through which said control components extend.

6. In a sewing machine as claimed in claim 2 wherein said panel means for providing access to said electronic means includes electronic components electrically connected with said electronic means of said electronic control board for selected control of said functional components.

7. In a sewing machine as claimed in claim 2 wherein said panel means for providing access to said electronic means includes mechanical means interengaging with said electronic means for selected control of said functional components.

8. In a sewing machine having a frame with at least one opening in a portion accessible to a sewing machine operator, said frame including a bed supporting functional components including a feed system and sewing instrumentalities, a standard rising from said bed and terminating in an arm over-hanging said bed; said arm supporting functional components including a needle bar gate journaled for lateral oscillation, said needle bar gate supporting a needle carrying needle bar for endwise reciprocation in cooperative arrangement with said sewing instrumentalities in said bed; said frame supporting functional components including a drive system for reciprocating said needle bar and driving said feed system, a pulse generator means operating in timed relation with said needle bar endwise reciprocation, power supply means, electrical actuating means for said needle bar gate oscillation, and regulating means for said feed system; wherein the improvement comprises:

an electronic control unit, one of a plurality of possible electronic control units, each having electronic means including selection elements, memory means and electronic circuitry responsive to pulses generated by said pulse generator to release pattern information from said memory means and convert said information to a form usable by said electrical actuating means for oscillation of said needle bar gate in the formation of sewing patterns and by other functional components of said sewing machine for control thereof, and each having panel means supporting elements interconnected with said electronic control unit for selected retrieval of information from said memory means for control of said functional components; means interchangeably supporting said electronic control unit with said panel means in said at least one opening in said frame; and means interconnecting said electronic control unit and said functional components.

* * * * *